US011866227B2

(12) United States Patent
Ingram

(10) Patent No.: US 11,866,227 B2
(45) Date of Patent: Jan. 9, 2024

(54) DIAMOND-PAINTING TRAY

(71) Applicant: Stacy Ingram, Rogers, AR (US)

(72) Inventor: Stacy Ingram, Rogers, AR (US)

( * ) Notice: Subject to any disclaimer, the term of this patent is extended or adjusted under 35 U.S.C. 154(b) by 0 days.

(21) Appl. No.: 17/660,124

(22) Filed: Apr. 21, 2022

(65) Prior Publication Data

US 2022/0340334 A1 Oct. 27, 2022

Related U.S. Application Data

(60) Provisional application No. 63/201,271, filed on Apr. 21, 2021.

(51) Int. Cl.
*B65D 25/10* (2006.01)
*B65D 25/38* (2006.01)
*B65D 1/34* (2006.01)

(52) U.S. Cl.
CPC ..... *B65D 25/107* (2013.01); *B65D 1/34* (2013.01); *B65D 25/38* (2013.01)

(58) Field of Classification Search
CPC ..... B65D 1/34; B65D 25/38; B65D 25/107
USPC ..... 206/1.7, 468, 528, 538, 540, 557, 561
See application file for complete search history.

(56) References Cited

U.S. PATENT DOCUMENTS 2,722,309 A * 11/1955 Waterman ..... B65D 83/0481 206/534.2
2,863,572 A * 12/1958 Bethard ..... A61J 7/02 414/675
2,917,162 A * 12/1959 Horland ..... B65D 83/04 206/536
2,948,389 A * 8/1960 Horland ..... B65D 83/04 206/536
3,747,756 A * 7/1973 Wheeler ..... B07C 7/04 D15/138
4,851,649 A * 7/1989 McCanney ..... A61J 7/02 235/1 R
4,978,510 A * 12/1990 Smith ..... A61L 2/18 206/439
5,117,982 A * 6/1992 Shotthafer ..... B07C 7/02 141/331
5,379,899 A * 1/1995 Thurell ..... A61J 1/03 206/538
5,947,294 A * 9/1999 Omata ..... G09F 3/20 220/523

* cited by examiner

*Primary Examiner* — Luan K Bui
(74) *Attorney, Agent, or Firm* — Dunlap Bennett & Ludwig, PLLC

(57) ABSTRACT

A diamond-painting tray dimensioned and adapted to controllably store and selectively dispense diamond-painting gems. The tray provides a ridged working surface for storing a plurality of gems in an organized manner, wherein the ridged working surface facilitates both the selective presentation and accessibility of the gems for engagement with a diamond-painting applicator. The tray also provides a sluice gate and opening for controlled dispensing of the gems, wherein adjacent ridges act as rails along which gems controllable slide along when the tray is tilted. Also, a transparent lid encloses the compartment defined by the working surface of the tray.

4 Claims, 3 Drawing Sheets

DIAMOND-PAINTING TRAY

CROSS-REFERENCE TO RELATED APPLICATION

This application claims the benefit of priority of U.S. provisional application No. 63/201,271, filed 21 Apr. 2021, the contents of which are herein incorporated by reference.

BACKGROUND OF THE INVENTION

The present invention relates to diamond painting and, more particularly, a diamond-painting tray dimensioned and adapted to controllably store and selectively dispense diamond-painting "gems".

Diamond painting is a hobby whereby hobbyists craft a sparkling piece of art by sequentially affixing scores of vibrantly colored resin rhinestones ("gems" or "diamonds") to a self-adhesive canvas. The canvas is typically printed with the design as well as symbols to let the hobbyist know exactly which color to place in each spot.

An associated 'diamond art kit' includes an applicator tool with a tip that is pressed into a source of wax, so that the wax-covered tip can contact a faceted (or smooth, in some embodiments) side of a "diamond" to pick it up, which can then be gently pressed into a place along the self-adhesive canvas. Thus, a diamond art kit includes hundreds of loose "gems" that need to be dispensed for application, wherein the gems are applied one by one via the applicator tool or stored for later use.

The gems themselves are typically ellipsoids, wherein their volume is defined by an ellipsoid shape, whose projected shape ("projection") is an ellipsoid. In many embodiments the gem may be defined as a 3-axial ellipsoid shape with its focal hyperbola. The exterior surface of each gem may be defined by multiple facets or they may be smooth (cabochon). Because of its ellipsoidal shape, typically each gem has two opposing surfaces/facets that are larger than the remaining surfaces/facets. Thus, one of these two opposing surfaces is the logical attachment point for the applicator tool so that the other opposing surface can be pressed against the self-adhesive canvas. Accordingly, a preferred condition for the loose gems prior to their application to the canvas is being disposed along a working surface one-gem deep, as opposed to being piled or jumbled on top of each other. Thus, a solution that facilitated moving a large, stored quantity of gems to this one-gem deep condition would be a boon to diamond-painting enthusiasts. If this solution also provided structure that facilitated isolating gems by shared properties, such as by color or shape, that too would benefit a diamond-painting hobbyist since this otherwise simple and addictive hobby can be time consuming and result in some otherwise enthusiastic users turning away from this relatively new art form.

As can be seen, there is a need for a diamond-painting tray dimensioned and adapted to controllably store and selectively dispense diamond-painting "gems".

The diamond-painting tray embodied in the present invention defines a compartment with a ridged working surface for storing a plurality of gems in an organized manner, i.e., in rows. The ridged working surface facilitates both the selective presentation and accessibility of the gems for engagement with a diamond-painting applicator. The tray also provides a sluice gate and opening for controlled dispensing of the gems, wherein adjacent ridges act as rails along which gems controllable slide along when the tray is tilted. Also, a transparent lid encloses the compartment defined by the working surface of the tray providing users with visibility while preventing gems from unintentionally spilling from the tray.

SUMMARY OF THE INVENTION

In one aspect of the present invention, a tray for a plurality of diamond-painting gems, the tray includes the following: a planar working surface having a plurality of ridges parallelly spaced apart, wherein each two adjacent ridges of the plurality of ridges are spaced apart by a distance that approximately defines a width of at least one diamond-painting gem of the plurality of diamond-painting gems; a plurality of walls orthogonally extending from a periphery of the working surface; a sluice opening provided between two walls of the plurality of walls; and a sluice gate operatively associated with the sluice so as to move between an open position and a closed position.

In another aspect of the present invention, the tray for a plurality of diamond-painting gems may further include a transparent lid dimensioned and adapted to engage an upper portion of the plurality of walls; a slot on each of two sides of the sluice opening, wherein the sluice gate slides along the two slots for moving between the open position and the closed position; a built-up structure at the distal ends of each of said walls, wherein the built-up structure just provides the respective slot, wherein a sluice edge of the working surface defined by the sluice opening is oriented in a sluice direction, and wherein a first edge of the working surface defined by a first wall of said two walls is angled relative to the sluice direction by an angle of incidence between thirty and sixty degrees, wherein a second edge of the working surface defined by a second wall of said two walls is a mirror image of the first edge relative to a longitudinal axis of the working surface, and wherein the at least one diamond-painting gem rides along each two adjacent ridges of the plurality of ridges when the working surface is tilted toward the sluice opening.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a diamond-painting tray dimensioned and adapted to controllably store and selectively dispense diamond-painting gems. The tray provides a ridged working surface for storing a plurality of gems in an organized manner, wherein the ridged working surface facilitates both the selective presentation and accessibility of the gems for engagement with a diamond-painting applicator. The tray also provides a sluice gate and opening for controlled dispensing of the gems, wherein adjacent ridges act as rails along which gems controllable slide along when the tray is tilted. Also, a transparent lid encloses the compartment defined by the working surface of the tray.

Figure 1:
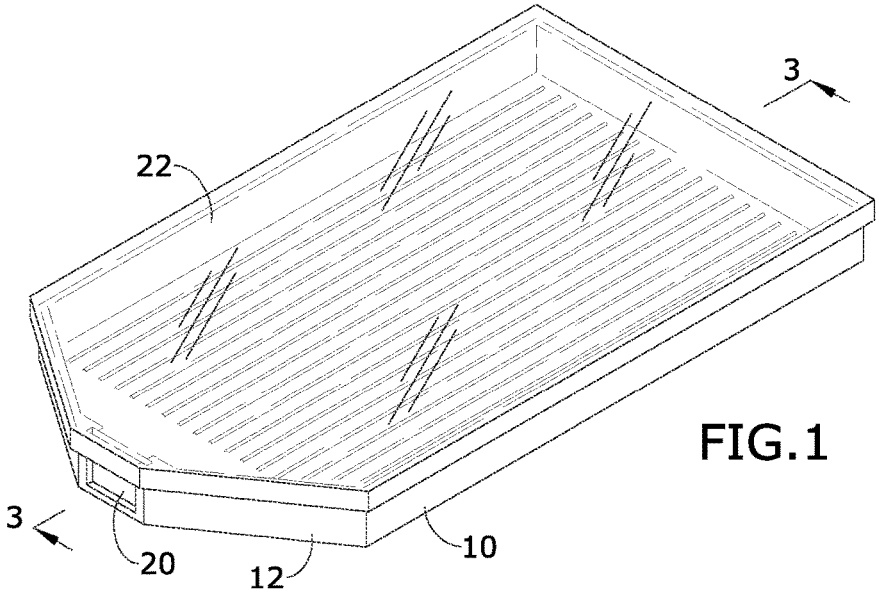
FIG. 1 is a perspective view of an exemplary embodiment of the present invention.
Figure 2:
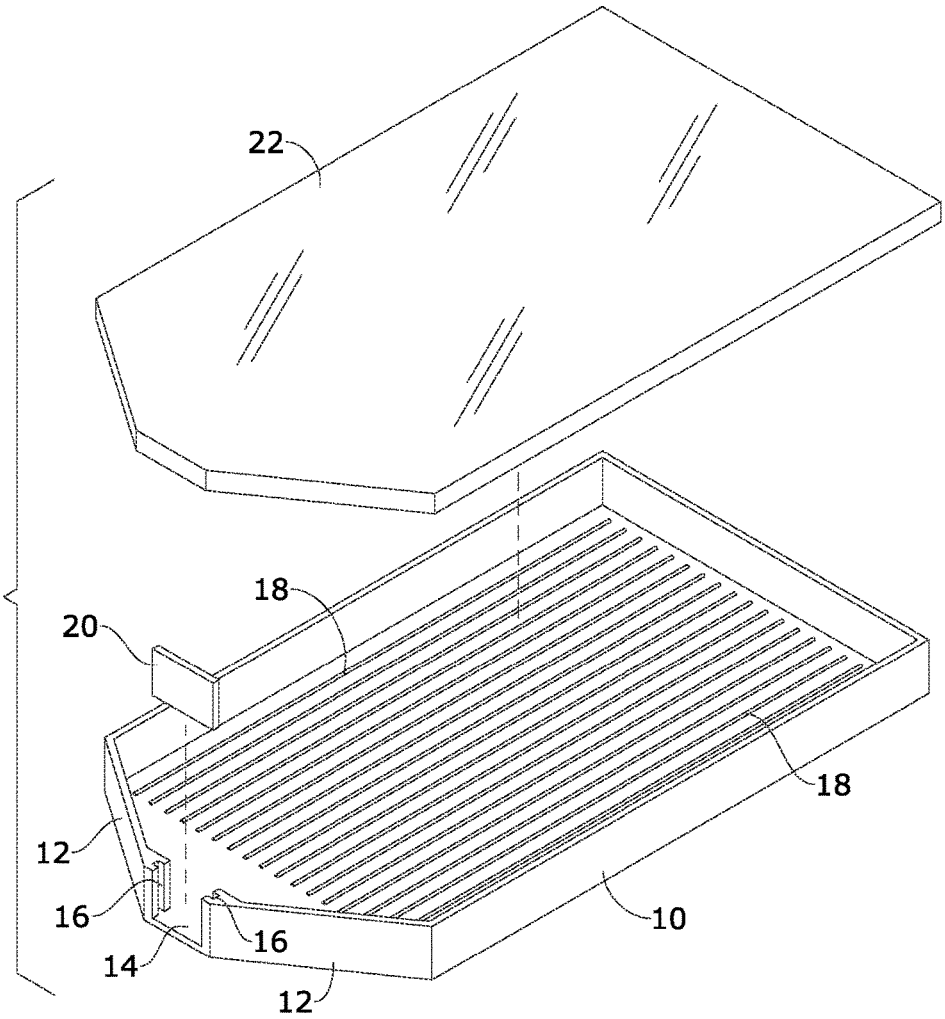
FIG. 2 is an exploded perspective view of an exemplary embodiment of the present invention.
Figure 3:
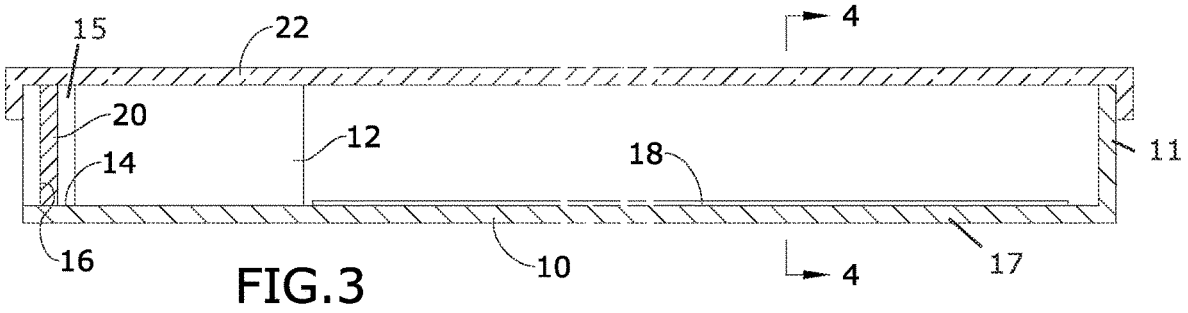
FIG. 3 is a section view of an exemplary embodiment of the present invention, taken along line 3-3 in FIG. 1.
Figure 4:
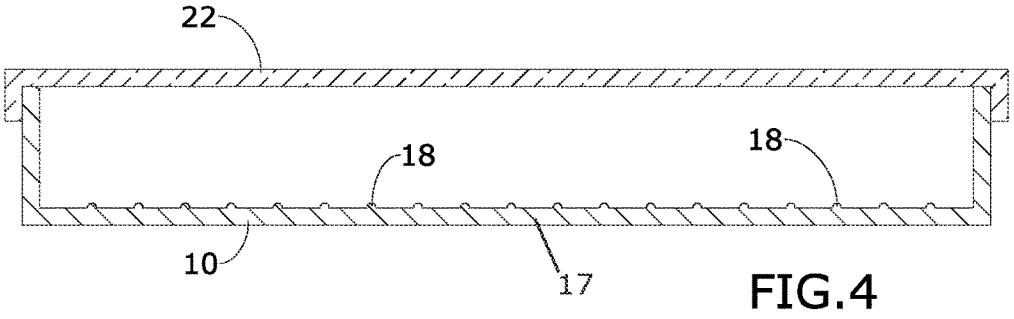
FIG. 4 is a section view of an exemplary embodiment of the present invention, taken along line 4-4 in FIG. 3.
Figure 5:
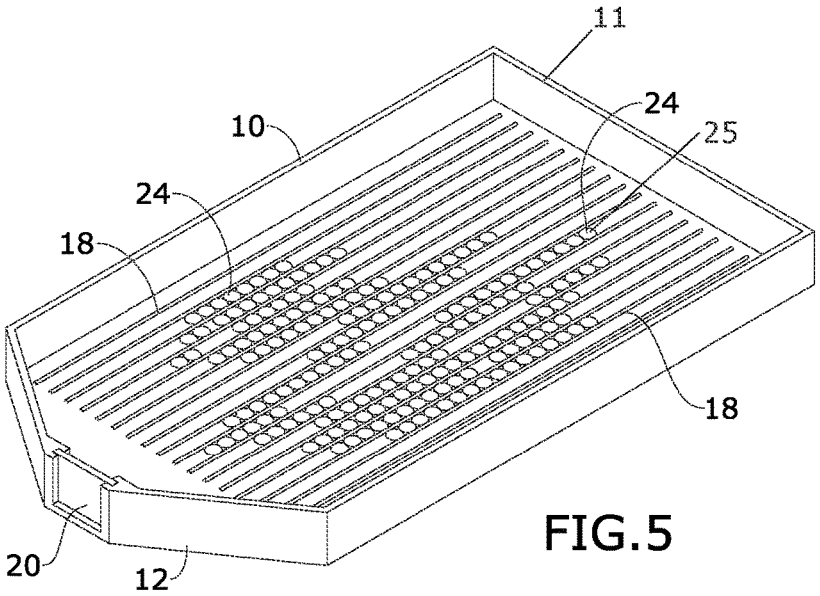
FIG. 5 is a perspective view of an exemplary embodiment of the present invention, shown in use.

Referring to FIGS. 1 through 6, the present invention may be a diamond-painting tray 10 dimensioned and adapted to controllably store and selectively dispense diamond-painting "gems" 24. The tray 10 may provide one or more sidewalls 11 extending along a periphery of a working surface 17. Along one edge of the working surface 17 may be two mirror-image angled sides 12 that terminate at opposing sides of a sluice opening 14, as illustrated in FIG. 2. Accordingly, the working surface 17 has a similar angled shape. Likewise, a lid 22 of the tray 10 has the angled shape to engage an upper surface of the one or more sidewalls 11 and the angled walls 12. The lid 22 may be transparent or semi-transparent.

The sluice opening 14 may be rectangular, as defined by the relevant portion of the working surface 17 and the two opposing ends of the angled sides 12. Just inward of the sluice opening 14, on each of its two opposing sides, may be slot structure 15 providing a slot 16 for slidably receiving a sluice gate 20.

Figure 6:
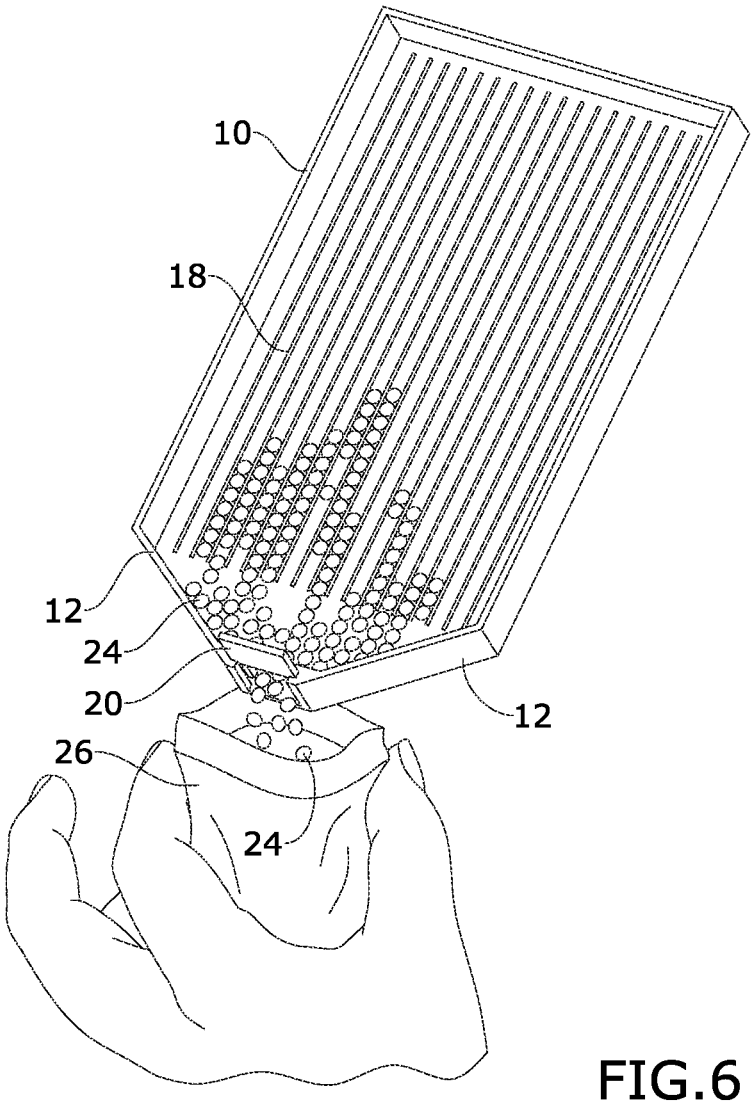
FIG. 6 is a perspective view of an exemplary embodiment of the present invention, shown in use.

The working surface 17 may be generally planar with a flat bottom surface and a top surface providing a plurality of spaced apart ridges 18. The ridges 18 may be spaced apart so that each two adjacent ridges 18 act as rails for simultaneously supporting opposing portions of a gem 24. This "rail configuration" facilitates sliding the gem 24 along the rails, as illustrated in FIG. 6. Also, the spacing between the ridges 18 may be dimensioned and adapted so that the two largest surfaces 25 (the bottom and the top surfaces shown in FIG. 5, as described above) of ellipsoidal shaped gem 24 are facing upward and downward. Facing downward, the bottom largest surface 25 would be supported by the working surface 17. As a result, a user of a diamond-drawing applicator may press against the unobstructed top largest surface 25 (as the two adjacent ridges bracket the opposing sides of the gem 24 and so do not obstruct access to the top largest surface 25) wherein the bottom largest surface 25 is urged against the flat working surface 17 between the two ridges 18, facilitating the engagement of said gem 24. By way of example, if a lateral width (e.g., parallel projection) of a gem 24 is two millimeters, then two adjacent ridges 18 are spaced apart approximately two millimeters.

The sluice opening 14 may be dimensioned and adapted to enable a plurality of gems 24 to pass therethrough simultaneously, as illustrated in FIG. 6. Thus, if the lateral width of a gem 24 is two millimeters, then the cross-sectional area of the sluice opening 14 may be approximately ten millimeters by ten millimeters.

The present invention provides a diamond-painting tray 10 with a transparent lid 22 that prevents the diamond-painting gems 24 from falling or spilling out. The lid 22 of the present invention may be constructed and arranged to cover the diamond-painting tray 10 and be opened either partially or fully so at least a portion of the lid 22 may be open.

When the lid 22 is in the closed condition, the sluice gate 20 may be moved to an open position permitting the user to pour a plurality of gems 24 through the sluice opening 14 and into another container 26, such as a bag, as illustrated in FIG. 6. Accordingly, the sluice opening 14 enables the user to control the removal of gems 24 from the tray 10, while in the tray 10 is otherwise sealed by the transparent lid.

The present invention distinguishes over and differs from existing solutions as this is the only diamond-painting tray commercially available with the above-mentioned structure and functionality, including the transparent lid.

The diamond-painting tray 10 may be constructed and arranged to cover any suitable tray working surface 17 and any plastic diamond painting gem tray of any size or dimensions. The tray may be made of any suitable material, and by any suitable fabrication process. For example, without limitation, in an exemplary embodiment the present invention may be made of molded plastic. The tray 10 may be any working surface 17 may be any size or shape. Nonlimiting examples of dimensions may be as follows: in some embodiments, the dimensions of the tray may be 4.7 cm by 9.0 cm; or in some embodiments the dimensions of the tray may be 9.0 cm by 16.0 cm.

In certain embodiments, the lid 22 may be pivotably connected to the tray 10, so that the lid is moveable between an open condition and the closed condition enclosing the upper portion of the tray's compartment.

It understood that the gems 24 may be beads, rhinestones, or any object formed in a variety of shapes and sizes of a material such as stone, bone, shell, glass, plastic, wood, or pearl and may range in size from under one millimeter to over one centimeter in diameter.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein, and so do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A tray for a plurality of diamond-painting gems, the tray comprises:

a plurality of diamond-painting gems, each diamond-painting gem comprising:

a gem width; and two opposing attachment facets that are larger than the remaining facets of the diamond-painting gem;

a planar working surface having a plurality of ridges parallelly spaced apart, wherein each two adjacent ridges of the plurality of ridges are spaced apart by a distance that approximately defines a rail width that is less than the gem width so that each diamond-painting gem rides, space apart from working surface, along said two adjacent ridges with the two opposing attachment facets oriented orthogonal relative to the working surface in an applicator condition;

a plurality of walls orthogonally extending from a periphery of the working surface;

a sluice opening provided between two walls of the plurality of walls;

a sluice gate operatively associated with the sluice opening so as to move between an open position and a closed position;

a transparent lid dimensioned and adapted to engage an upper portion of the plurality of walls; and a slot on each of two sides of the sluice opening, wherein the sluice gate slides along the two slots for moving between the open position and the closed position, whereby the applicator condition enables unobstructed access to one of the two opposing attachment facets by way of a gem diamond-painting applicator.

2. The tray of claim 1, further comprising a built-up structure at the distal ends of each of said walls, wherein the built-up structure just provides the respective slot.

3. The tray of claim 2, wherein a sluice edge of the working surface defined by the sluice opening is oriented in a sluice direction, and wherein a first edge of the working surface defined by a first wall of said two walls is angled relative to the sluice direction by an angle of incidence between thirty and sixty degrees.

4. The tray of claim 3, wherein a second edge of the working surface defined by a second wall of said two walls is a mirror image of the first edge relative to a longitudinal axis of the working surface.

* * * * *